US008657411B2

(12) United States Patent
Anderson et al.

(10) Patent No.: US 8,657,411 B2
(45) Date of Patent: Feb. 25, 2014

(54) FLUID EJECTION DEVICE AND METHOD FOR FABRICATING FLUID EJECTION DEVICE

(75) Inventors: Frank Anderson, Sadieville, KY (US); Jiandong Fang, Lexington, KY (US)

(73) Assignee: Funai Electric Co., Ltd., Osaka (JP)

( * ) Notice: Subject to any disclaimer, the term of this patent is extended or adjusted under 35 U.S.C. 154(b) by 88 days.

(21) Appl. No.: 13/160,568

(22) Filed: Jun. 15, 2011

(65) Prior Publication Data

US 2012/0320130 A1 Dec. 20, 2012

(51) Int. Cl.
*B41J 2/14* (2006.01)
*B41J 2/05* (2006.01)

(52) U.S. Cl.
USPC ..... 347/47; 347/63

(58) Field of Classification Search
None
See application file for complete search history.

(56) References Cited

U.S. PATENT DOCUMENTS

2009/0189954 A1* 7/2009 Anderson et al. ..... 347/50
2009/0256891 A1* 10/2009 Anderson et al. ..... 347/61

* cited by examiner

*Primary Examiner* — Lisa M Solomon
(74) *Attorney, Agent, or Firm* — Amster, Rothstein & Ebenstein LLP

(57) ABSTRACT

Disclosed is a fluid ejection device that includes a nozzle plate. The nozzle plate includes a plurality of nozzles. Further, the fluid ejection device includes a flow feature layer. The flow feature layer includes a plurality of flow features. The fluid ejection device further includes an ejection unit. The ejection unit includes a first layer. The first layer includes a plurality of fluid vias. Further, the ejection unit includes a second layer. The second layer includes a plurality of fluid channels. Further, the second layer is attached to the first layer through a first intermediate silicon oxide layer. The ejection unit also includes a third layer. The third layer includes a plurality of ports. The third layer is also attached to the second layer through a second intermediate silicon oxide layer. Further disclosed are an ejection unit for a fluid ejection device and a method for fabricating the fluid ejection device.

9 Claims, 8 Drawing Sheets

FLUID EJECTION DEVICE AND METHOD FOR FABRICATING FLUID EJECTION DEVICE

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to a fluid ejection device for inkjet printers, and more particularly, to a fluid ejection device that provides a narrow print zone in the media transport direction for better print quality when multiple devices are formed end-to-end in an array.

2. Description of the Related Art

Typically, a printer, such as an inkjet printer, includes a page wide fluid ejection device (printhead) that has an array of narrow ejection chip units (e.g. heater chips). In general, the width of such narrow ejection chip units is less than about two millimeters (mm). Further, each ejection chip unit of the page wide fluid ejection device includes about four to five fluid (ink) channels for fluids (inks) of colors, such as Cyan, Magenta, Yellow, and blacK (CMYK). FIG. 1 depicts a three dimensional exploded view of a typical narrow ejection chip unit, such as an ejection chip unit 100, of a typical page wide fluid ejection device. The ejection chip unit 100 includes a first ultra thin layer 102 having a plurality of fluid vias 104 to feed firing chambers (not shown) of the fluid ejection device for fluid ejection. The plurality of fluid vias 104 is hereinafter referred to as 'vias 104'. Each via of the vias 104 is connected to a corresponding firing chamber (not shown) of the fluid ejection device such that each firing chamber is fed by a single via of the vias 104.

The ejection chip unit 100 further includes a substrate layer 106 having a plurality of fluid (ink) channels 108, across the length of the ejection chip unit 100. For the purpose of this description, the ejection chip unit 100 includes four fluid channels 108 that are adapted to carry the fluids (inks) of cyan color, magenta color, yellow color and black color, respectively. The fluid channels 108 are configured beneath the vias 104 on the substrate layer 106. Each fluid channel of the fluid channels 108 is fluidly coupled with at least one corresponding via of the vias 104. The term, "at least one corresponding via" as to used herein refers to one or more vias of the vias 104 that are aligned with a respective fluid channel of the fluid channels 108 and may carry a fluid ink of the same color as carried by the respective fluid channel.

Furthermore, the ejection chip unit 100 includes a second ultra thin layer 110 having a plurality of ports 112 configured beneath the fluid channels 108. The plurality of ports 112 is hereinafter referred to as 'ports 112'. At least one port of the ports 112 may be fluidly coupled with a corresponding fluid channel of the fluid channels 108. The term, "a corresponding fluid channel" as used herein refers to a fluid channel of the fluid channels 108 that may be aligned with respective at least one port of the ports 112 and may carry a fluid of the same color as carried by the respective at least one port. As depicted in FIG. 1, the fluid channels 108 are sandwiched between the first ultra thin layer 102 and the second ultra thin layer 110. Specifically, the first ultra thin layer 102, the substrate layer 106, and the second ultra thin layer 110 may be formed from different wafers that are bonded to each other to constitute a wafer stack and to configure the ejection chip unit 100.

It is to be observed that the spacing (seal width) between the two adjacent fluid channels of the fluid channels 108 is as narrow as 0.1 mm, as depicted by distance 'D1' in FIG. 2 that illustrates a side cross-sectional partial view of a fluid ejection device 10 employing the ejection chip unit 100 shown with the two adjacent fluid channels of the fluid channels 108 of FIG. 1, and attached with a flow feature layer 12 and a nozzle plate 14. Such narrow seal width averts the use of adhesive bonding that requires wide spacing for the dispensing of an adhesive to connect the ejection chip unit 100 to a substrate (not shown), which is further attached to one or more fluid reservoirs (not shown). Accordingly, to achieve such narrow seal width, direct silicon bonding techniques, such as fusion bonding, anodic bonding and the like, may be employed. Thereafter, patterning of the ports 112, may be carried out, wherein the spacing between nearest ports may be maintained at about 0.2-0.8 mm, which is suitable for low temperature adhesive bonding. Also, fabrication of a photo-imagable nozzle plate (PINP) requires low temperature post processes.

Further, to minimize fluidic resistance within the fluidic ejection device 10, the thickness of the first ultra thin layer 102 and the second ultra thin layer 110 is required to be kept minimum, typically around 30 microns (0.03 mm). Therefore, to achieve such minimum thickness, wafer grinding is required from both sides of the wafer stack formed by bonding the different wafers used to form the first ultra thin layer 102, the substrate layer 106, and the second ultra thin layer 110 of FIG. 1. However, the embedded fluid channels 108 of the substrate layer 106 greatly challenge the grinding of the bonded wafers to achieve such narrow thickness without any cracks. Further, it was observed that a crack-free grinding process may only assist in achieving a minimum of about 0.1 mm thick membrane (i.e., the first ultra thin layer 102) over the fluid channels 108 that is still far away from the expected 0.03 mm thickness for acceptable fluidic resistance in order to provide a narrow print zone for better print quality.

Accordingly, there persists a need for an effective and efficient fluid ejection device and a method for fabricating the fluid ejection device, for providing a narrow print zone for better print quality.

SUMMARY OF THE DISCLOSURE

In view of the foregoing disadvantages inherent in the prior art, the general purpose of the present disclosure is to provide a fluid ejection device, an ejection unit and a method for fabricating the fluid ejection device, by including all the advantages of the prior art, and overcoming the drawbacks inherent therein.

In one aspect, the present disclosure provides a fluid ejection device that includes a nozzle plate. The nozzle plate includes a plurality of nozzles configured therewithin for fluid ejection. Further, the fluid ejection device includes a flow feature layer configured below the nozzle plate. The flow feature layer includes a plurality of flow features. Each flow feature of the plurality of flow features is configured in fluid communication with at least one nozzle of the plurality of nozzles. The fluid ejection device further includes an ejection unit configured below the flow feature layer. The ejection unit includes a first layer configured below the flow feature layer. The first layer includes a plurality of fluid vias configured therewithin. Each fluid via of the plurality of fluid vias is configured in fluid communication with at least one flow feature of the plurality of flow features. Further, the ejection unit includes a second layer configured below the first layer. The second layer includes a plurality of fluid channels. Each fluid channel of the plurality of fluid channels is configured in fluid communication with at least one fluid via of the plurality of fluid vias. Further, the second layer is attached to the first layer through a first intermediate silicon oxide layer. The ejection unit also includes a third layer configured below the second layer. The third layer includes a plurality of ports. At least one port of the to plurality of ports is configured in fluid communication with a corresponding fluid channel of the plurality of fluid channels. The third layer is also attached to the second layer through a second intermediate silicon oxide layer.

According to another aspect, the present disclosure provides an ejection unit for a fluid ejection device. The ejection unit includes a first layer. The first layer includes a plurality of fluid vias configured therewithin. The ejection unit further includes a second layer configured below the first layer. The second layer includes a plurality of fluid channels. Each fluid channel of the plurality of fluid channels is configured in fluid communication with at least one fluid via of the plurality of fluid vias. Further, the second layer is attached to the first layer through a first intermediate silicon oxide layer. The ejection unit also includes a third layer configured below the second layer. The third layer includes a plurality of ports configured therewithin. At least one port of the plurality of ports is configured in fluid communication with a corresponding fluid channel of the plurality of fluid channels. Further, the third layer is attached to the second layer through a second intermediate silicon oxide layer.

According to yet another aspect, the present disclosure provides a method of fabricating a fluid ejection device. The method includes bonding a first silicon wafer to a second silicon wafer with a first intermediate silicon oxide layer such that the first intermediate oxide layer is sandwiched between the first silicon wafer and the second silicon wafer. The method further includes forming at least one first pair of trenches by etching the second silicon wafer up to the first intermediate silicon oxide layer. Furthermore, the method includes filling the at least one first pair of trenches with silicon oxide. The method further includes grinding the second silicon wafer from a bottom portion thereof up to a first predetermined thickness. The method also includes bonding a third silicon wafer to the second silicon wafer with a second intermediate silicon oxide layer such that the second intermediate silicon oxide layer is sandwiched between the third silicon wafer and the second silicon wafer. Additionally, the method includes grinding the first silicon wafer from a top portion thereof up to a second predetermined thickness, and grinding the third silicon wafer from a bottom portion thereof up to a third predetermined thickness. The method also includes forming at least one second pair of trenches by etching the third silicon wafer up to the second intermediate silicon oxide layer.

Moreover, the method includes filling the at least one second pair of trenches to with silicon oxide. In addition, the method includes etching the third silicon wafer, the second intermediate silicon oxide layer, and the second silicon wafer up to the first intermediate silicon oxide layer and along the at least one second pair of trenches and the at least one first pair of trenches. The third silicon wafer is etched to configure at least one port therewithin. Further, the method includes isotropically etching silicon material of the second silicon wafer confined between each first pair of trenches of the at least one first pair of trenches to configure at least one fluid channel within the second silicon wafer. The method also includes configuring at least one fluid via within the first silicon wafer. Additionally, the method includes depositing and patterning a flow feature layer and a nozzle plate on the first silicon wafer.

BRIEF DESCRIPTION OF THE DRAWINGS

The above-mentioned and other features and advantages of the present disclosure, and the manner of attaining them, will become more apparent and will be better understood by reference to the following description of embodiments of the disclosure taken in conjunction with the accompanying drawings, wherein.

DETAILED DESCRIPTION

It is to be understood that various omissions and substitutions of equivalents are contemplated as circumstances may suggest or render expedient, but these are intended to cover the application or implementation without departing from the spirit or scope of the claims of the present disclosure. It is to be understood that the present disclosure is not limited in its application to the details of components set forth in the following description. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a"

and "an" herein do not denote a limitation of quantity, but rather denote the presence of at least one of the referenced item.

The present disclosure provides a fluid ejection device for an inkjet printer. The fluid ejection device includes a nozzle plate. The nozzle plate includes a plurality of nozzles configured therewithin for fluid ejection. Further, the fluid ejection device includes a flow feature layer configured below the nozzle plate. The flow feature layer includes a to plurality of flow features. Each flow feature of the plurality of flow features is configured in fluid communication with at least one nozzle of the plurality of nozzles. The fluid ejection device further includes an ejection unit (e.g. heater chip) configured below the flow feature layer. The ejection unit includes a first layer configured below the flow feature layer. The first layer includes a plurality of fluid vias configured therewithin. Each fluid via of the plurality of fluid vias is configured in fluid communication with at least one flow feature of the plurality of flow features. Further, the ejection unit includes a second layer configured below the first layer. The second layer includes a plurality of fluid channels. Each fluid channel of the plurality of fluid channels is configured in fluid communication with at least one fluid via of the plurality of fluid vias. Further, the second layer is attached to the first layer through a first intermediate oxide layer. The ejection unit also includes a third layer configured below the second layer. The third layer includes a plurality of ports. At least one port of the plurality of ports is configured in fluid communication with a corresponding fluid channel of the plurality of fluid channels. The third layer is also attached to the second layer through a second intermediate oxide layer. The fluid ejection device of the present disclosure is explained in conjunction with FIGS. 3 and 4.

Figure 1:
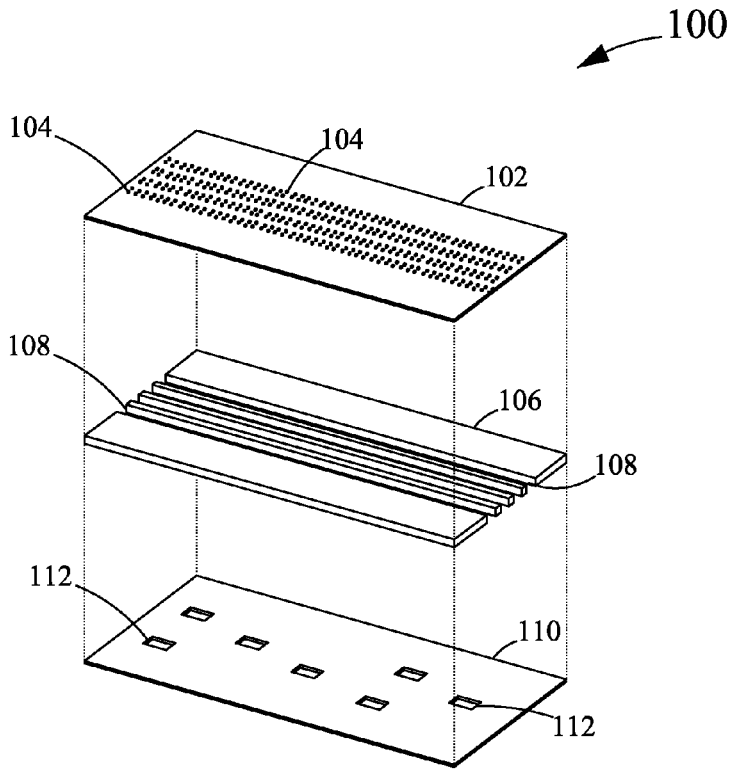
Figure 1 (Prior art)
FIG. 1 depicts a three dimensional exploded view of a prior art ejection chip unit of a typical fluid ejection device.
Figure 2:
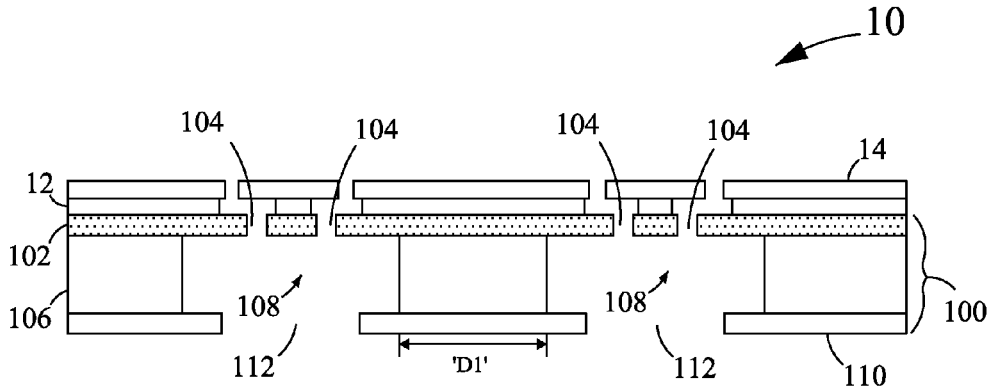
Figure 2 (Prior art)
FIG. 2 depicts a side cross-sectional partial view of the fluid ejection device employing the ejection chip unit of FIG. 1, illustrating two adjacent fluid channels of the ejection chip unit.
Figure 3:
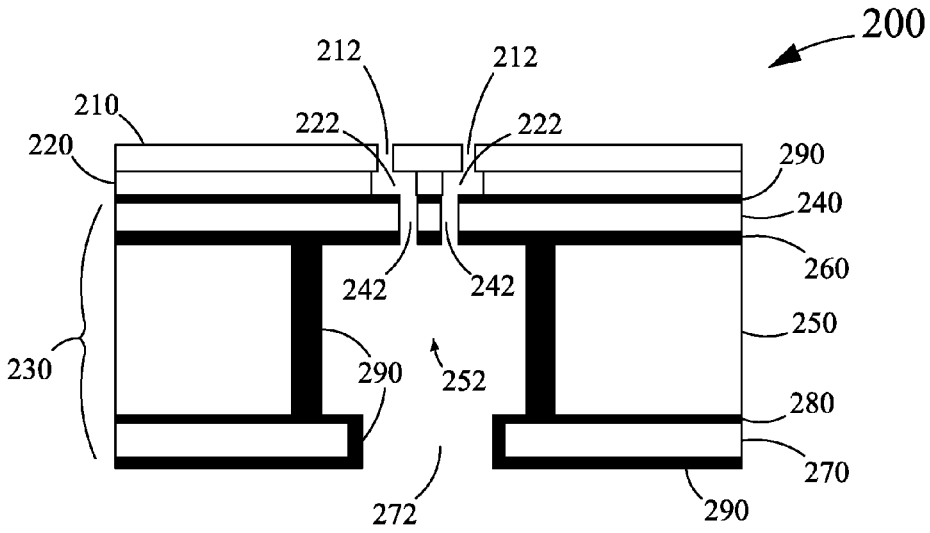
FIG. 3 depicts a side cross-sectional partial view of a fluid ejection device, in accordance with an embodiment of the present disclosure.

FIG. 3 depicts a side cross-sectional partial view of a fluid ejection device 200 of a printer, such as an inkjet printer (not shown). The fluid ejection device 200 includes a nozzle plate 210. The nozzle plate 210 is a rectangular-shaped plate and may be made of any material as known in the art. Further, the nozzle plate 210 forms a top portion (not numbered) of the fluid ejection device 200. It is to be understood that the material and shape of the nozzle plate 210 should not be considered as a limitation to the present disclosure, as the material and the shape of the nozzle plate 210 may be chosen as per a manufacturer's preference. The nozzle plate 210 includes a plurality of nozzles 212 configured therewithin for fluid ejection. During printing, the nozzles 212 allow a fluid, such as an ink, to be ejected therefrom on to a medium to be printed. Further, the nozzles 212 may be configured to have a conical frustum shape, thereby, allowing optimum flow of the fluid therefrom. It is to be understood that the shape and structure of the nozzles 212 should not be considered as a limitation to the present disclosure.

The fluid ejection device 200 further includes a flow feature layer 220 configured below the nozzle plate 210 to support the nozzle plate 210. The flow feature layer 220 may be composed of a semiconductor material, such as silicon material and the like, to thereby providing sufficient strength to withstand wear and tear during the use of the printer. According to the present embodiment of the present disclosure, the flow feature layer 220 is a rectangular-shaped block. However, the flow feature layer 220 may be configured to have any other shape, without departing from the scope of the present disclosure.

The flow feature layer 220 further includes a plurality of flow features 222 (fluid chamber and fluid channel). Each flow feature of the flow features 222 is configured in fluid communication with at least one nozzle of the nozzles 212. In the present embodiment, the each flow feature of the flow features 222 is configured in fluid communication with corresponding one nozzle of the nozzles 212. The fluid communication between the each flow feature of the flow features 222 and the corresponding one nozzle of the nozzles 212 facilitates the flow of the fluid from the flow feature layer 220 to the nozzle plate 210 during a printing process.

Further, the fluid ejection device 200 includes an ejection unit 230 configured below the flow feature layer 220. The ejection unit 230 includes a first layer 240 configured below the flow feature layer 220. The first layer 240 has a thickness less than or equal to about 80 micrometers. More specifically, such thickness of the first layer 240 is achieved by grinding a first silicon wafer used for making the first layer 240, up to a particular thickness. Furthermore, the first layer 240 includes a plurality of fluid vias 242 configured therewithin. Each fluid via of the fluid vias 242 is in fluid communication with at least one flow feature of the flow features 222. In the present embodiment, the each fluid via of the fluid vias 242 is in one to one communication with a corresponding flow feature of the flow features 222. The fluid communication between the each fluid via of the fluid vias 242 and the corresponding flow feature of the flow features 222 facilitates the flow of the fluid from the first layer 240 to the flow feature layer 220 during the printing process. For example, during printing, the fluid is transferred from the fluid vias 242 towards the nozzles 212 through the flow features 222 of the flow feature layer 220. The fluid vias 242 may be configured in the form of a through slot/channel along the thickness of the first layer 240. Further, the fluid vias 242 may be configured to have any suitable shape, such as a rectangular shape, a circular shape and the like.

Furthermore, the ejection unit 230 includes a second layer 250 configured below the first layer 240. The second layer 250 has a thickness of about 300 micrometers. More specifically, such thickness of the second layer 250 is achieved by grinding a second to silicon wafer used for making the second layer 250, up to a particular thickness. The second layer 250 includes a plurality of fluid channels 252. For simplicity, only one fluid channel of the fluid channels 252 is depicted in FIG. 3. Each fluid channel of the fluid channels 252 is configured in fluid communication with at least one fluid via of the vias 242. As depicted in FIG. 3 and according to the present embodiment, two fluid vias of the fluid vias 242 are in fluid communication with a single fluid channel of the fluid channels 252. The each fluid channel of the fluid channels 252 is configured to have a width of about 0.15 millimeters. Further, the second layer 250 is attached to the first layer 240 through a first intermediate layer 260 as depicted in FIG. 3. The first intermediate layer 260 is made of silicon oxide material acting as a bonding material between the first layer 240 and the second layer 250. Alternatively, the first intermediate layer 260 may be made of any other suitable bonding material, and particularly, oxide-based bonding material, as known in the art. Further, the bonding between the first layer 240 and the second layer 250 is carried out by a fusion bonding method.

As shown in FIG. 3, the ejection unit 230 also includes a third layer 270 configured below the second layer 250. The third layer 270 has a thickness less than or equal to about 80 micrometers. More specifically, such thickness of the third layer 270 is achieved by grinding a third silicon wafer used for making the third layer 270, up to a particular thickness. The third layer 270 includes a plurality of ports 272. At least one port of the ports 272 is in fluid communication with a corresponding fluid channel of the fluid channels 252. In the present embodiment, a single port of the ports 272 is in fluid communication with a single corresponding fluid channel of the fluid channels 252. It is to be understood that more than one port of the ports 272 may also be configured in fluid communication with a single fluid channel of the fluid channels 252. For simplicity, only one port of the ports 272 is shown in FIG. 3. Further, the third layer 270 is attached to the second layer 250 through a second intermediate silicon oxide layer 280. The second intermediate silicon oxide layer 280 is similar to the first intermediate silicon oxide layer 260 and is made of silicon oxide material that acts as a bonding material between the second layer 250 and the third layer 270. Alternatively, the second intermediate layer 280 may be made of any other suitable bonding material, and particularly, oxide-based bonding material, as known in the art. Further, the bonding between the second layer 250 and the third layer 270 is also carried out by a fusion bonding method.

Also, the each fluid channel of the fluid channels 252 is coated with a silicon oxide material 290 at an inner surface (not numbered) thereof. Such a coating forms a cage type structure that encloses the each fluid channel. Further, the silicon oxide material 290 also at least partially encapsulates the first layer 240 and the third layer 270; and each port of the ports 272. Accordingly, the silicon oxide material 290 and the first intermediate silicon oxide layer 260 at least partially encapsulate the first layer 240 therewithin; and the silicon oxide material 290 and the second intermediate silicon oxide layer 280 at least partially encapsulate the third layer 270 therewithin.

Figure 4:
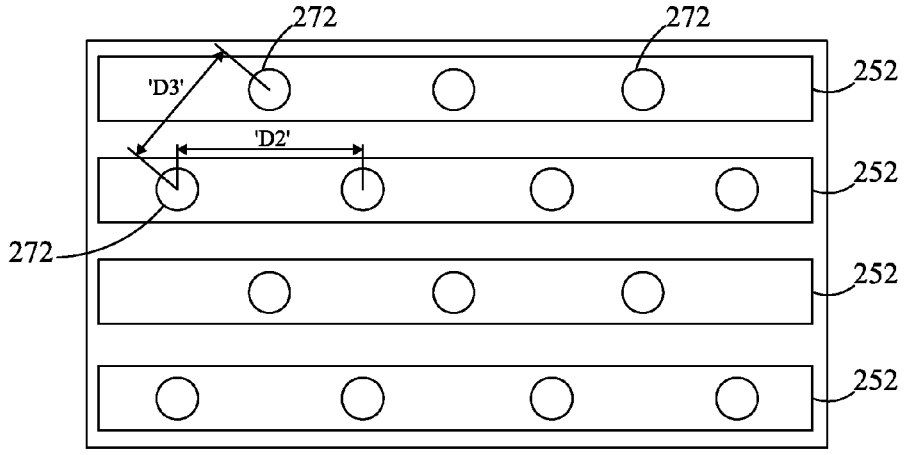
FIG. 4 depicts a schematic configuration of a plurality of ports and a plurality of fluid channels of the fluid ejection device of FIG. 3.

Referring now to FIG. 4, the each port of the ports 272 configured in fluid communication with the corresponding fluid channel of the fluid channels 252 is configured at a first predetermined distance from an adjacent port of the ports 272 configured in fluid communication with the same corresponding fluid channel of the fluid channels 252. Further, the first predetermined distance between the adjacent ports of the ports 272 configured in fluid communication with the same corresponding fluid channel of the fluid channels 252 is about 0.6-2 millimeters, as depicted by distance 'D2' in FIG. 4. Furthermore, a port of the ports 272 configured in fluid communication with a first fluid channel of the fluid channels 252 is configured at a second predetermined distance from an adjacent port of the ports 272 configured in fluid communication with a second fluid channel of the fluid channels 252, wherein the first fluid channel and the second fluid channel are configured adjacent to each other and separated at a distance of about 0.05-0.2 millimeters. The second predetermined distance is about 0.3-0.8 millimeters, as depicted by distance 'D3' in FIG. 4.

Furthermore, the fluid ejection device 200 may include a supporting structure (not shown) attached to the third layer 270 of the ejection unit 230. The supporting structure is a silicon substrate that may further be connected to one or more fluid reservoirs to provide fluid to the fluid ejection device 200. Further, the second predetermined distance, as depicted by 'D3' in FIG. 4 is the seal width that facilitates adhesive bonding to become feasible for connecting the ejection unit 230 with the supporting structure.

In another aspect, the present disclosure provides an ejection unit, such as the ejection unit 230 of FIG. 3, for a fluid ejection device, such as the fluid ejection device 200 of the present disclosure. The ejection unit includes a first layer, such as the first layer 240 of to FIG. 3. Further, the ejection unit includes a second layer, such as the second layer 250 of FIG. 3. The ejection unit also includes a third layer, such as the third layer 270 of FIG. 3. The ejection unit is structurally and functionally similar to the ejection unit 230 of the fluid ejection device 200, and accordingly, the description of the ejection unit is herein avoided for the sake of brevity. Also, the ejection unit may be employed in any fluid ejection device that requires a narrow ejection unit in the media transport direction for better print quality.

Figure 5A:
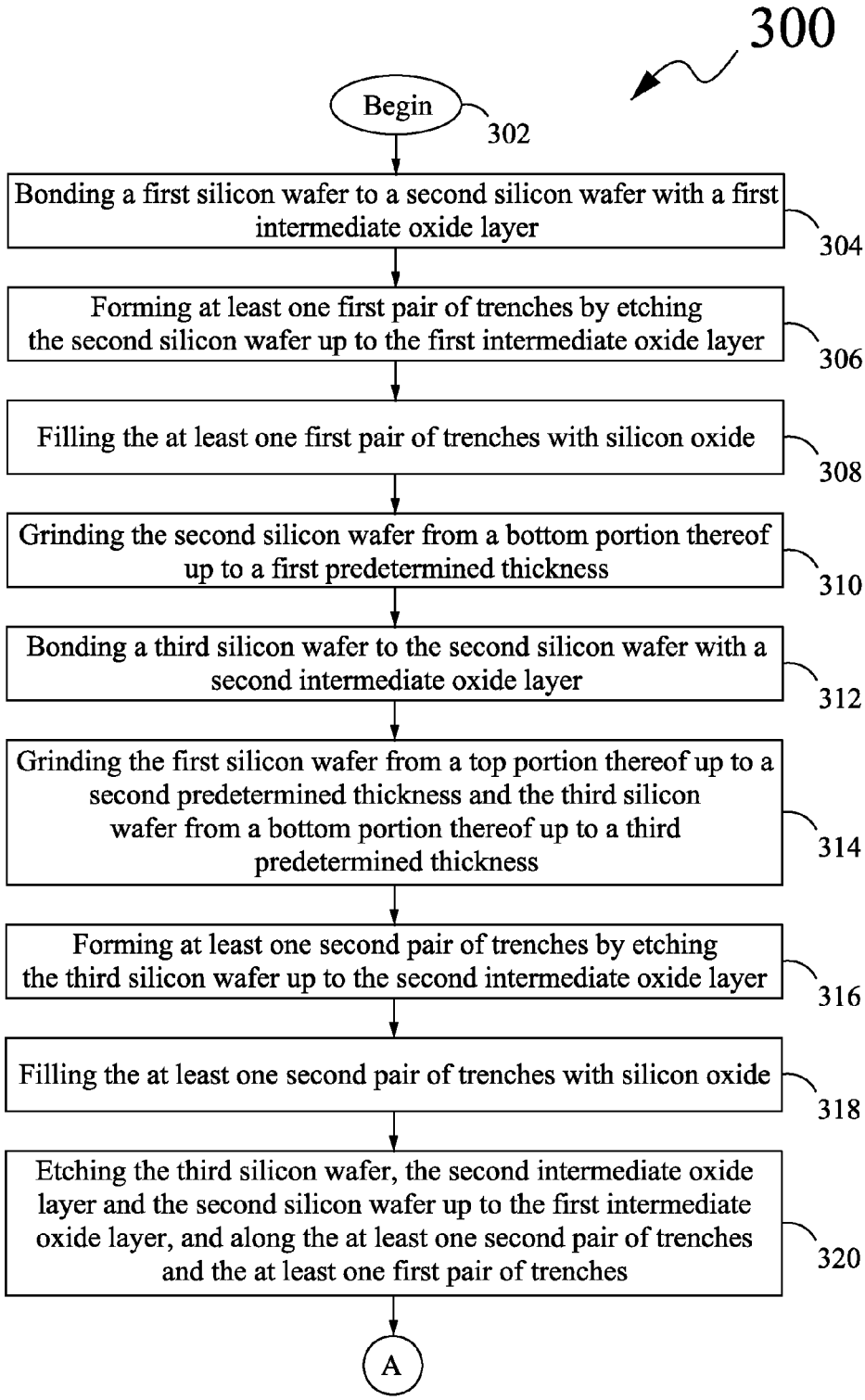
FIGS. 5A and 5B depict a flow chart illustrating a method of fabricating the fluid ejection device of FIG. 3, in accordance with an embodiment of the present disclosure.
Figure 5B:
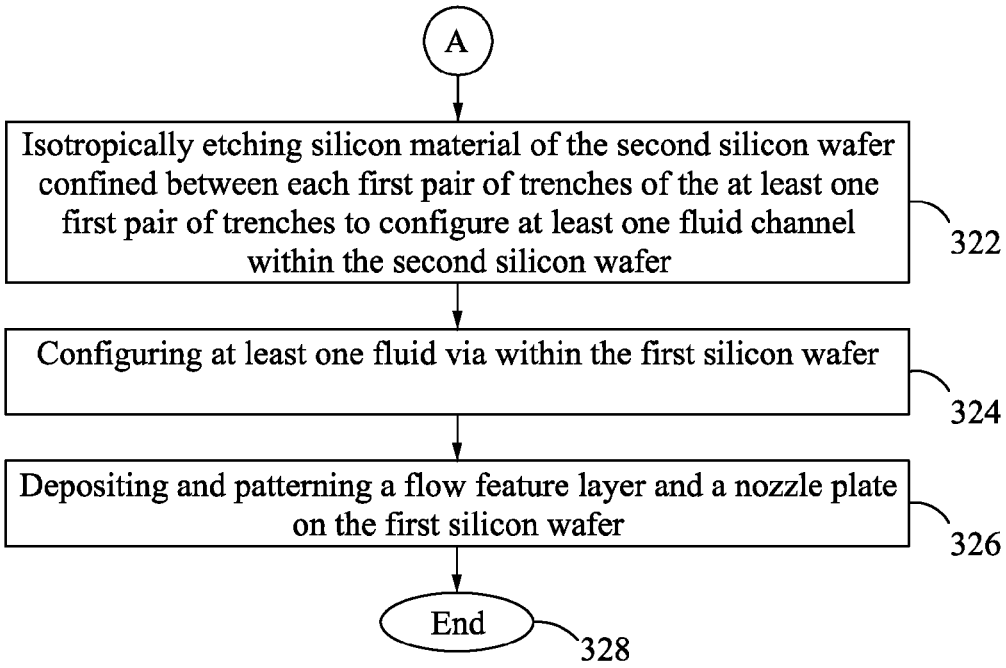

In yet another aspect, the present disclosure provides a method of fabricating a fluid ejection device, such as the fluid ejection device 200, as explained in conjunction with FIGS. 5A and 5B. Further, reference will be made to the fluid ejection device 200 and components thereof as explained in FIG. 3. Furthermore, FIGS. 6-16 are used to illustrate a process flow for fabricating the fluid ejection device 200 using the method of FIGS. 5A and 5B.

Figure 6:
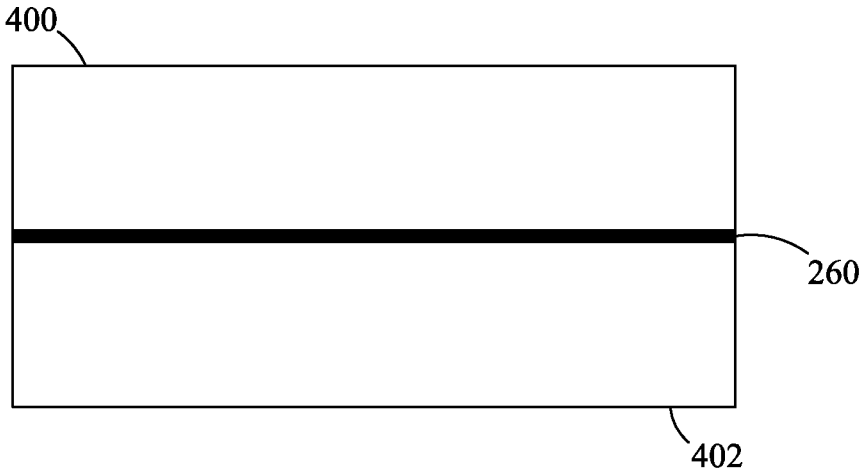
FIGS. 6-8 depict side cross-sectional partial views for a plurality of silicon wafers being used in a process flow for fabricating the fluid ejection device of FIG. 3.

FIG. 5A and FIG. 5B illustrate a flow chart for a method 300 for fabricating the fluid ejection device 200. The method 300 begins at 302. At 304, a first silicon wafer 400 is bonded to a second silicon wafer 402 with a first intermediate silicon oxide layer, such as the first intermediate oxide layer 260 of the fluid ejection device 200, as depicted in FIG. 6. The first silicon wafer 400 is bonded to a second silicon wafer 402 by utilizing a fusion bonding method, as known in the art. Further, the first intermediate silicon oxide layer 260 is sandwiched between the first silicon wafer 400 and the second silicon wafer 402 as depicted in FIG. 6.

Figure 7:
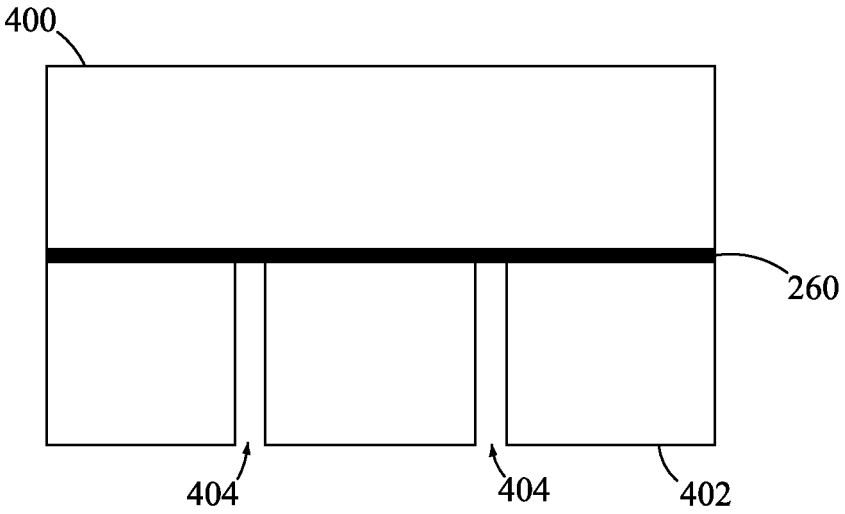
Figure 8:
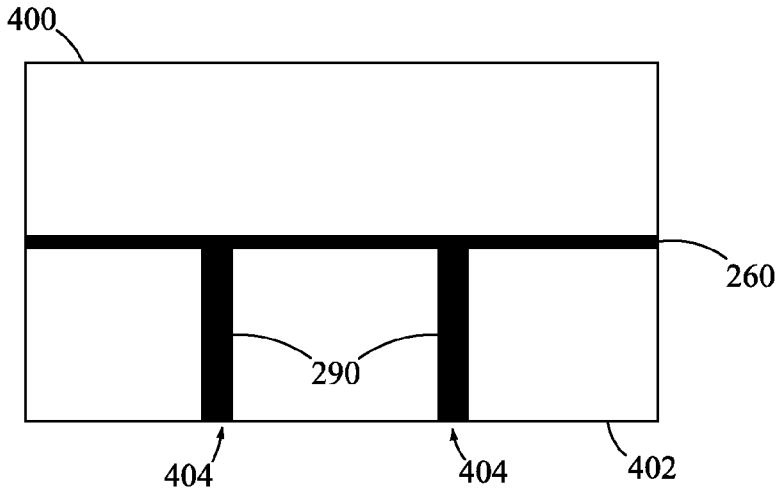
Figure 9:
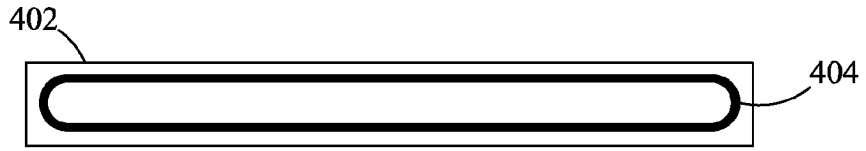
FIG. 9 depicts a bottom view of a silicon wafer of the plurality of silicon wafers being used for the fabrication of the fluid ejection device of FIG. 3.

At 306, at least one first pair of trenches 404 is formed by etching the second silicon wafer 402 up to the first intermediate silicon oxide layer 260, as depicted in FIG. 7. The second silicon wafer 402 is etched by utilizing deep reactive ion etching (DRIE) technique. Further, each first pair of trenches of the at least one first pair of trenches 404 formed within the second silicon wafer 402 defines an outline of a fluid channel of the fluid channels 252 of the fluid ejection device 200 (as depicted in FIG. 3). At 308, the at least one first pair of trenches 404 is filled with the silicon oxide material 290, as depicted in FIG. 8. Further, the at least one first pair of trenches 404 is filled with the silicon oxide material 290 using a technique such as a chemical vapor deposition (CVD) technique, a spin-on glass technique, and the like. At 310, the second silicon wafer 402 is ground from a bottom portion (not numbered) thereof to a first predetermined thickness of about 300 to micrometers thereby, forming the second layer 250 of FIG. 3. The second silicon wafer 402 may be ground by using any technique as known in the art. For example, a grinding apparatus may be used for grinding the second silicon wafer 402. Further, FIG. 9 depicts a bottom view of the second silicon wafer 402 when allowed to undergo grinding. More specifically, FIG. 9 depicts the filled at least one first pair of trenches 404 in the shape of a silicon oxide ring around a fluid channel when viewed from bottom.

Figure 10:
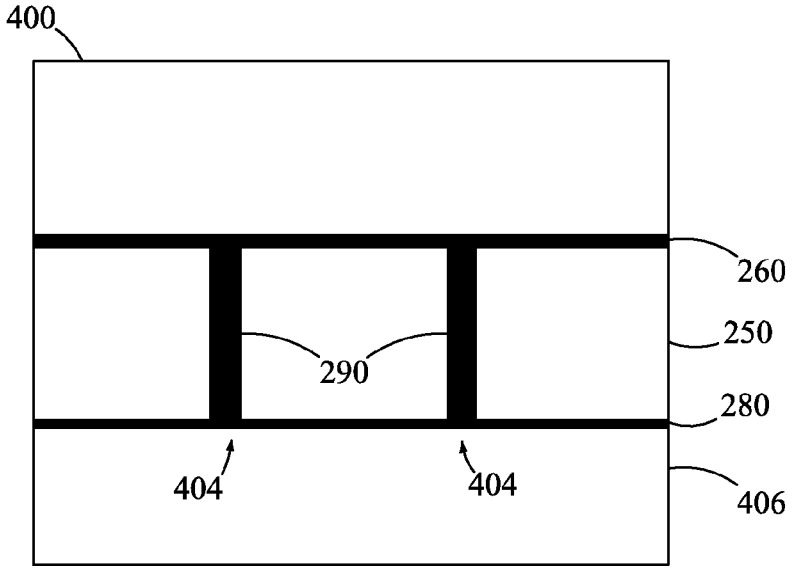
FIGS. 10-12 depict side cross-sectional partial views for the plurality of silicon wafers being used in the process flow for fabricating the fluid ejection device of FIG. 3, in continuation of FIGS. 6-8.

At 312, a third silicon wafer 406 is bonded to the second layer 250 (i.e., the ground second silicon wafer 402) with a second intermediate silicon oxide layer, such as the second intermediate silicon oxide layer 280 of the fluid ejection device 200, as depicted in FIG. 10. The third silicon wafer 406 is bonded to the second layer 250 by utilizing a fusion bonding method as known in the art. Further, the second intermediate silicon oxide layer 280 is sandwiched between the third silicon wafer 406 and the second layer 250, as depicted in FIG. 10.

Figure 11:
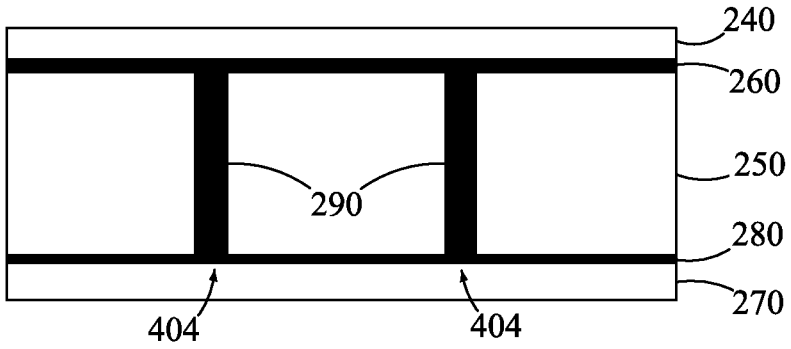
Figure 12:
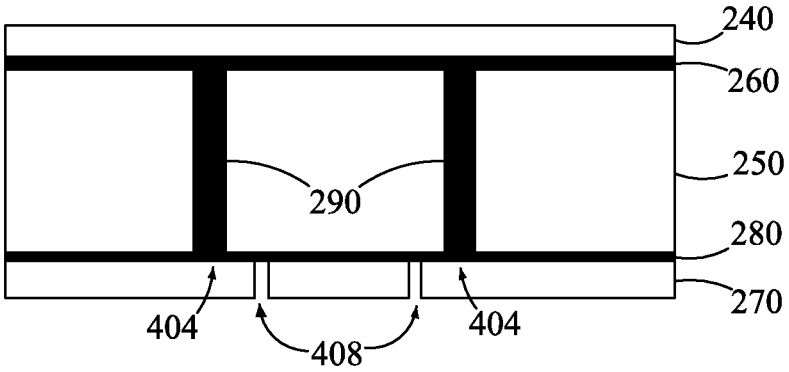

Thereafter, at 314 the first silicon wafer 400 is ground from a top portion (not numbered) thereof up to a second predetermined thickness equal to or less than about 60 micrometers (as depicted in FIG. 11), thereby, forming the first layer 240 of FIG. 3. Similarly, the third silicon wafer 406 is ground from a bottom portion (not numbered) thereof up to a third predetermined thickness equal to or less than about 80 micrometers (as depicted in FIG. 11), thereby, forming the third layer 270 of FIG. 3. The first silicon wafer 400 and the third silicon wafer 406 may be ground by using any technique as known in the art. For example, a grinding apparatus may be used for grinding the first silicon wafer 400 and the third silicon wafer 406. At 316, at least one second pair of trenches 408 is formed by etching the third layer 270 (i.e., the ground third silicon wafer 406) up to the second intermediate silicon oxide layer 280 as depicted in FIG. 12. The at least one second pair of trenches 408 is formed by utilizing DRIE technique for etching the third layer 270 up to the second intermediate silicon oxide layer 280. Further, each second pair of trenches of the at least one second pair of trenches 408 defines an outline of a port of the ports 272 of FIG. 3.

Figure 13:
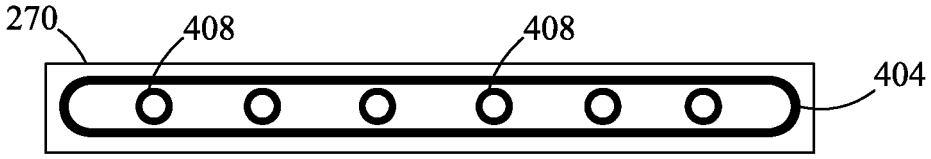
FIG. 13 depicts a bottom view of another silicon wafer of the plurality of silicon wafers being used for the fabrication of the fluid ejection device of FIG. 3, illustrating outlines of at least one port being configured within the silicon wafer.
Figure 14:
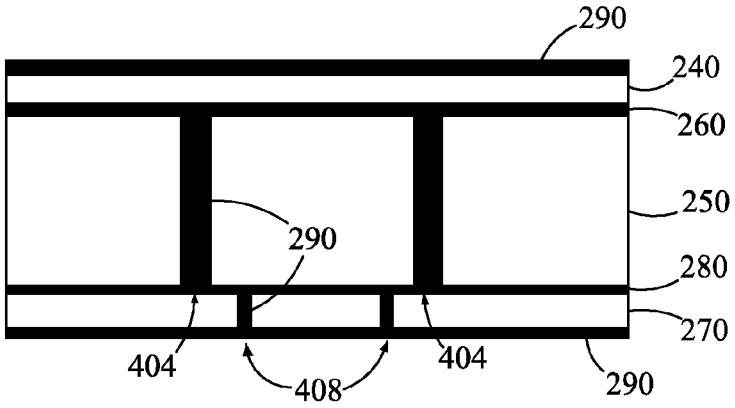
FIGS. 14-16 depict side cross-sectional partial views for the plurality of silicon wafers being used for fabricating the fluid ejection device of FIG. 3, in continuation of FIGS. 10-12.

FIG. 13 depicts a bottom view of the third layer 270 (i.e., the ground third silicon wafer 406) of the fluid ejection device 200 of FIG. 3 with the ports 272 formed from the at least one second pair of trenches 408. FIG. 13 also depicts the otherwise hidden at least one first pair of trenches 404 in the bottom view of the third layer 270, for the purpose of explanation. At 318, the at least one second pair of trenches 408 is filled with silicon oxide material 290, as depicted in FIG. 14. The at least second pair of trenches 408 is filled with the silicon oxide material 290 by utilizing a technique such as a thermally growth technique, a CVD technique, a physical vapor deposition (PVD) technique, and the like. Further, the silicon oxide material 290 is used to at least partially coat the first layer 240 and the third layer 270.

Figure 15:
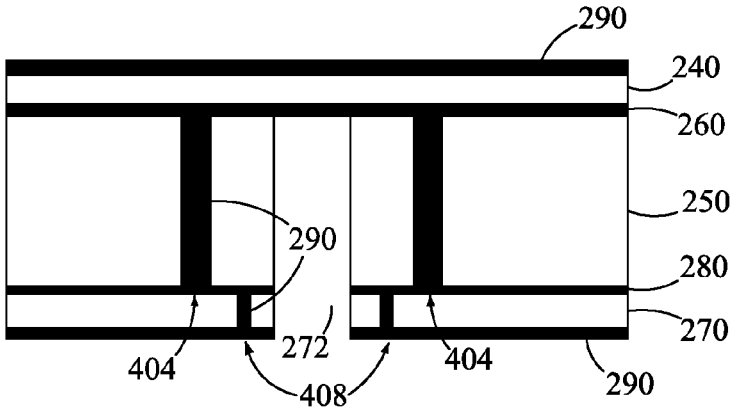

At 320, the third layer 270, the second intermediate silicon oxide layer 280, and the second layer 250 are etched along the at least one second pair of trenches 408 and the at least one first pair of trenches 404, as depicted in FIG. 15. The third layer 270 and the second layer 250 are etched (by utilizing DRIE technique) up to the first intermediate silicon oxide layer 260, and the second intermediate silicon oxide layer is etched using Tetrafluoromethane ($CF_4$) plasma etchant. Further, the third layer 270 is etched to configure the at least one port of the ports 272 of the ejection unit 230 (as depicted in FIG. 3) therewithin as depicted in FIG. 15.

Figure 16:
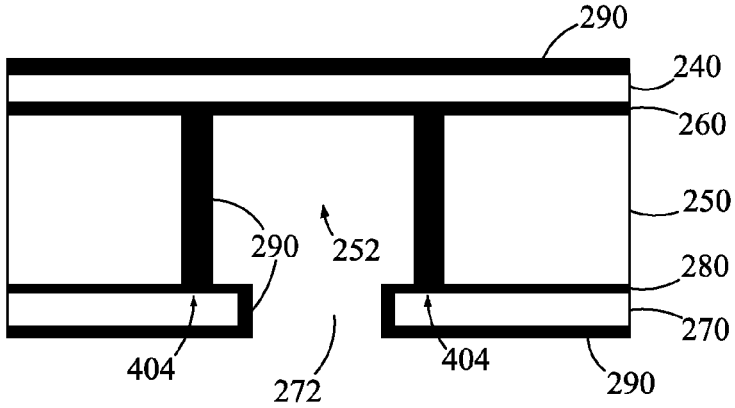

At 322, the silicon material of the second layer 250 confined between the each first pair of trenches of the at least one first pair of trenches 404 is isotropically etched to configure at least one fluid channel, such as the fluid channels 252, of the ejection unit 230 (as depicted in FIG. 3) within the second layer 250, as depicted in FIG. 16. The isotropic etching also assists in appropriately shaping and configuring the at least one port of the ports 272. Further, the isotropic etching is carried out by utilizing Xenon Fluoride ($XeF_2$) chemical etchant. The etching selectivity of $XeF_2$ on silicon and silicon oxide is above 1000, so the lateral isotropic silicon etching stops at the predefined silicon oxide cage surface (formed by the silicon oxide material 290 at the inner surface of the each fluid channel). Also, the first intermediate oxide layer 260 may be thicker than the second intermediate oxide layer 280 due to a role thereof as etching stop for both silicon DRIE technique and $XeF_2$ isotropic etching. To minimize the lateral $XeF_2$ etching time to tunnel through the fluid channels 252 from the ports 272, the spacing between two neighboring ports of the ports 272 in the same fluid channel 252 needs to be minimized. Specifically, the first predetermined distance 'D3', as depicted in FIG. 4 serves as the minimum spacing between two neighboring ports of the ports 272 in the same color fluid channel of the fluid channels 252 that allows the respective fluid channel to be tunneled through by the lateral $XeF_2$ etching from both sides of the neighboring ports towards each other. Thus, the ports 272 are configured in a manner as depicted in FIG. 4 to satisfy both minimum spacing ('D2') between same color ports of the to ports 272 and 0.2-0.6 millimeters adhesive sealing width ('D3'). The isotropic etching is carried out after all Complementary Metal Oxide Semiconductor (CMOS) circuitry and ejection (e.g. heater) elements are fabricated on top of the first layer 240.

Further, at 324, at least one fluid via, such as the fluid vias 242 of FIG. 3, is configured within the first layer 240 by utilizing DRIE technique. Thereafter, at 326, a flow feature layer such as the flow feature layer 220 of FIG. 3 and a nozzle plate, such as the nozzle plate 210 of FIG. 3 are deposited and patterned on the first layer 240 as depicted in FIG. 3. The flow feature layer 220 and the nozzle plate 210 may be configured using any technique known in the art. At 328, the method 300 ends.

The present disclosure provides a fluid ejection device, such as the fluid ejection device 200, having a narrow ejection unit, such as the ejection unit 230 with ultra thin first layer, such as the first layer 240, and the ultra thin third layer, such as the third layer 270. Thus, the present disclosure provides an effective ejection unit for fluid ejection devices.

Furthermore, the present disclosure provides an effective and efficient method, such as the method 300, for fabricating the fluid ejection device 200. Specifically, the method 300 facilitates grinding of a first silicon wafer, such as the first silicon wafer 400, a second silicon wafer, such as the second silicon wafer 402, and a third silicon wafer, such as the third silicon wafer 406, before physically configuring a plurality of fluid channels, such as the fluid channels 252, in order to facilitate the narrow ejection unit to sustain high mechanical strength during the grinding process. More specifically, the method 300 facilitates in fabricating narrow ejection units with four or more color fluid channels sandwiched by two ultra thin (0.05 millimeter or even thinner) layers of silicon (i.e., the first layer 240 and the third layer 270). Further, grinding before the formation of the fluid channels 252 assists in achieving very thin channel membrane (i.e., the second layer 250). Thus, wafer stack constituted by the first silicon wafer 400, the second silicon wafer 402 and the third silicon wafer 406, has high mechanical strength without any cavities (i.e., fluid channels) to easily survive the grinding process. Further, the fluid channels 252 are predefined with silicon oxide cages before grinding, and are then formed by isotropic etching with $XeF_2$ after the grinding process. Therefore, efficient fluid ejection devices with narrow ejection units may easily be fabricated to provide a narrow print zone for better print quality while averting the ejection units to undergo any damage, such as cracking.

The foregoing description of several embodiments of the present disclosure has been presented for purposes of illustration. It is not intended to be exhaustive or to limit the disclosure to the precise forms disclosed, and obviously many modifications and variations are possible in light of the above teaching. It is intended that the scope of the disclosure be defined by the claims appended hereto.

What is claimed is:

1. A fluid ejection device comprising:

a nozzle plate, the nozzle plate comprising a plurality of nozzles configured therewithin for fluid ejection;

a flow feature layer configured below the nozzle plate, the flow feature layer comprising a plurality of flow features, each flow feature of the plurality of flow features configured in fluid communication with at least one nozzle of the plurality of nozzles; and an ejection unit configured below the flow feature layer, the ejection unit comprising, a first layer configured below the flow feature layer, the first layer comprising a plurality of fluid vias configured therewithin, each fluid via of the plurality of fluid vias configured in fluid communication with at least one flow feature of the plurality of flow features, a second layer configured below the first layer, the second layer comprising a plurality of fluid channels, each fluid channel of the plurality of fluid channels configured in fluid communication with at least one fluid via of the plurality of fluid vias, the second layer being attached to the first layer through a first intermediate silicon oxide layer, and a third layer configured below the second layer, the third layer comprising silicon and having a plurality of ports, at least one port of the plurality of ports configured in fluid communication with a corresponding fluid channel of the plurality of fluid channels, the third layer being attached to the second layer through a second intermediate silicon oxide layer.

2. The fluid ejection device of claim 1, wherein the third layer has a thickness less than or equal to about 80 micrometers.

3. The fluid ejection device of claim 1, wherein the first layer has a thickness less than or equal to about 80 micrometers.

4. The fluid ejection device of claim 1, wherein each port of the plurality of ports configured in fluid communication with a corresponding fluid channel of the plurality of fluid channels is configured at a first predetermined distance from an adjacent port of the plurality of ports configured in fluid communication with the corresponding fluid channel of the plurality of fluid channels.

5. The fluid ejection device of claim 4, wherein the first predetermined distance is about 0.6-2 millimeters.

6. The fluid ejection device of claim 1, wherein a port of the plurality of ports configured in fluid communication with a first fluid channel of the plurality of fluid channels is configured at a second predetermined distance from an adjacent port of the plurality of ports configured in fluid communication with a second fluid channel of the plurality of fluid channels, and wherein the first fluid channel and the second fluid channel are configured adjacent to each other.

7. The fluid ejection device of claim 6, wherein the second predetermined distance is about 0.3-0.8 millimeters.

8. The fluid ejection device of claim 1, further comprising a supporting structure attached to the third layer of the ejection unit.

9. An ejection unit for a fluid ejection device, the ejection unit comprising, a first layer comprising a plurality of fluid vias configured therewithin;

a second layer configured below the first layer, the second layer comprising a plurality of fluid channels, each fluid channel of the plurality of fluid channels configured in fluid communication with at least one fluid via of the plurality of fluid vias, the second layer being attached to the first layer through a first intermediate silicon oxide layer; and a third layer configured below the second layer, the third layer comprising silicon and having a plurality of ports, at least one port of the plurality of ports configured in fluid communication with a corresponding fluid channel of the plurality of fluid channels, the third layer being attached to the second layer through a second intermediate silicon oxide layer.

* * * * *